US008864396B2

(12) United States Patent
Iguchi

(10) Patent No.: US 8,864,396 B2
(45) Date of Patent: Oct. 21, 2014

(54) PRINTING APPARATUS, CONTROL METHOD OF PRINTING APPARATUS, AND STORAGE MEDIUM

(71) Applicant: Canon Kabushiki Kaisha, Tokyo (JP)

(72) Inventor: Shunsuke Iguchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/689,470

(22) Filed: Nov. 29, 2012

(65) Prior Publication Data

US 2013/0142559 A1 Jun. 6, 2013

(30) Foreign Application Priority Data

Dec. 1, 2011 (JP) ..... 2011-263387

(51) Int. Cl.

| | |
|---|---|
| ***G03G 21/00*** | (2006.01) |
| ***B65H 1/30*** | (2006.01) |
| ***B41J 11/48*** | (2006.01) |
| ***B41J 13/00*** | (2006.01) |

(52) U.S. Cl.

CPC ..... *B41J 13/0009* (2013.01); *B41J 11/485* (2013.01); *B41J 13/0018* (2013.01)

USPC ..... 400/642; 399/391; 271/9.01

(58) Field of Classification Search

CPC ..... G03G 21/00; B65H 2601/322; B65H 1/30

USPC ..... 400/624; 399/391; 271/9.01, 9.03, 9.05, 271/9.06

See application file for complete search history.

(56) References Cited

U.S. PATENT DOCUMENTS

| | | | | |
|---|---|---|---|---|
| 2008/0003011 | A1 * | 1/2008 | Unno | 399/82 |
| 2009/0261524 | A1 | 10/2009 | Nakayama | |
| 2010/0295235 | A1 * | 11/2010 | Kanamoto | 271/9.01 |

FOREIGN PATENT DOCUMENTS

| | | | | |
|---|---|---|---|---|
| CN | 1188913 | A | 7/1998 | |
| CN | 1991606 | A | 7/2007 | |
| CN | 101004669 | A | 7/2007 | |
| JP | 200636423 | * | 2/2006 | B65H 1/26 |
| JP | 2009-256077 | A | 11/2009 | |

* cited by examiner

*Primary Examiner* — Daniel J Colilla
*Assistant Examiner* — Blake A Tankersley
(74) *Attorney, Agent, or Firm* — Canon USA, Inc. IP Division

(57) ABSTRACT

In order to enables a user to easily specify a sheet storage unit to which sheets are supplied next without confirming an operation unit, there is provided a method for controlling a printing apparatus for feeding a sheet from any one of a plurality of sheet storage units to print an image on the fed sheet. The method includes receiving an instruction to open a sheet storage unit, specifying, according to the received instruction, based on an attribute set to the sheet storage unit to which the instruction is issued, another sheet storage unit which has an attribute same as the attribute, and controlling the other specified sheet storage unit to be opened.

9 Claims, 13 Drawing Sheets

PRINTING APPARATUS, CONTROL METHOD OF PRINTING APPARATUS, AND STORAGE MEDIUM

BACKGROUND OF THE INVENTION

1. Field of the Invention

The present invention relates to a printing apparatus, a control method of the printing apparatus, and a storage medium.

2. Description of the Related Art

There are conventional printing apparatuses which feed a sheet from one of a plurality of sheet storage units and print an image on thus fed sheet.

Among such conventional printing apparatuses, in a case where a sheet storage unit is run out of sheets during print processing, some can continue printing by changing the sheet storage unit to the other sheet storage unit storing sheets of the same size as that of the sheets being used in printing. Accordingly, a possibility of stopping print processing can be decreased even in a case where a large amount of printing is executed.

However, in a case where a larger amount of print is executed, even if the sheets set in each of a plurality of sheet storage units are used, there is a case where the sheet storage units are still short of sheets. Since the print processing is stopped at the time when the sheet storage units are run out of sheets during the print processing, productivity is decreased. To avoid the decrease in the productivity, a user may supply sheets by opening a sheet storage unit which is not used for printing during the print processing.

Conventionally, in a case where a user supplies sheets, the user needs to look at a screen of an operation unit of the printing apparatus, confirm a sheet feeding state, specify a sheet storage unit which is set to store sheets of the same size, and supply sheets to the specified sheet storage unit. For example, Japanese Patent Application Laid-open No. 2009-256077 discusses a technique for grouping a plurality of sheet storage units to notify a user of sheet storage units other than the sheet storage unit in use among the grouped sheet storage units via an operation unit.

However, in a large printing apparatus capable of printing a large amount sheets, there is a physically large distance between the operation unit and the sheet storage units. Therefore, a user needs to supply sheets by coming and going between the operation unit and the sheet storage unit in order to confirm the sheet storage unit to be supplied with sheets and actually supply sheets thereto.

SUMMARY OF THE INVENTION

According to an aspect of the present invention, a printing apparatus for feeding a sheet from any one of a plurality of sheet storage units to print an image on the fed sheet includes a receiving unit configured to receive an instruction to open a sheet storage unit, a specifying unit configured to specify, according to the instruction received by the receiving unit, based on an attribute set to the sheet storage unit to which the instruction is issued, another sheet storage unit to which an attribute same as the attribute is set, and a control unit configured to control the other sheet storage unit specified by the specifying unit to be opened.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

<Description of System Configuration>

Figure 1:
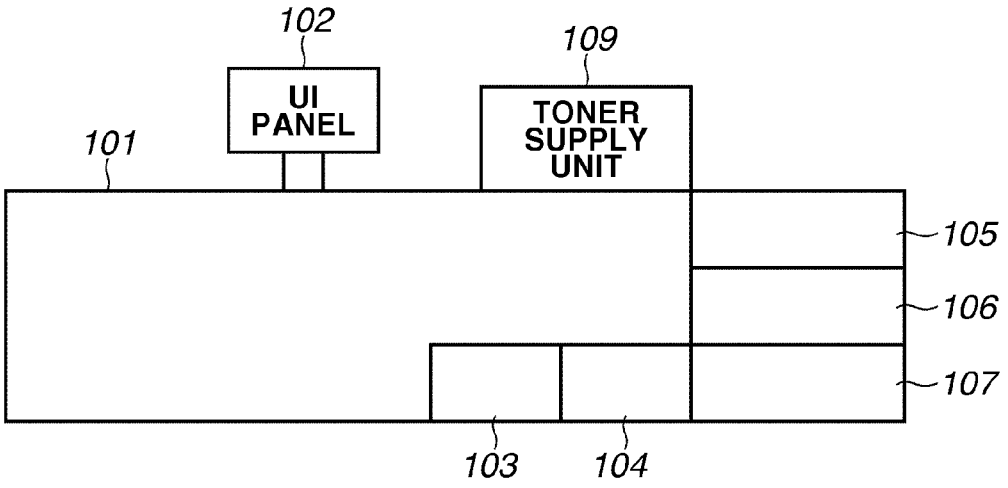
FIG. 1 illustrates a general configuration of a printing apparatus according to an exemplary embodiment of the present invention.

FIG. 1 illustrates a printing apparatus according to a first exemplary embodiment. In FIG. 1, a printing apparatus 101 includes a user interface (UI) panel 102, sheet cassettes (i.e., sheet storage units) 103 through 107. The printing apparatus may further include a scanner and a finisher (not illustrated). In the printing apparatus 101, a sheet is fed from any one of the sheet cassettes 103 through 107 and an image is printed on thus fed sheet. The UI panel 102 includes a liquid crystal display (LCD) with a touch panel, displays an operation screen through which an operation is received from a user, and receives the operation from the user via the operation screen. The UI panel 102 further includes hard keys through which an operation is received from the user.

The sheet cassettes 103 through 107 store sheets to be used in printing. Each of the sheet cassettes 103 through 107 includes a locking mechanism for locking the sheet cassette so as not to open and close according an instruction from a controller of the below described printing apparatus 101. In a case where the printing apparatus 101 includes a scanner, the scanner reads an image of a document to generate image data indicating the image. In a case where the printing apparatus 101 includes a finisher, the finisher performs stapling and/or punching on a sheet which is printed by a printing unit of the printing apparatus 101.

<Configuration of Sheet Cassette>

Figure 2:
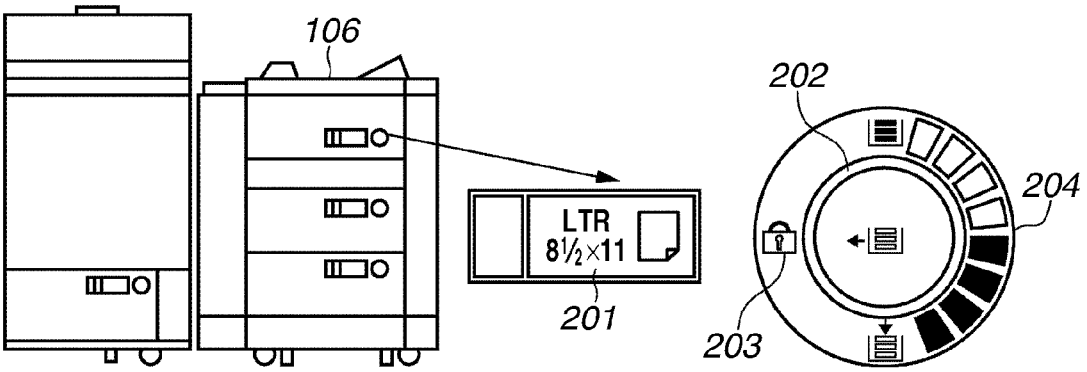
FIG. 2 illustrates a locking mechanism of a plurality of sheet storage units equipped to the printing apparatus.

FIG. 2 illustrates the locking mechanism of each of the sheet cassettes 103 through 107 of the printing apparatus 101 illustrated in FIG. 1. The locking mechanism of each of the plurality of sheet cassettes 103 through 107 is locked and unlocked according to an instruction from the controller of the printing apparatus 101. In FIG. 2, for example, when a user presses a button (i.e., switch) 202 in order to draw out a sheet cassette, the sheet cassette corresponding to the pressed button 202 is drawn out as far as the corresponding sheet cassette is not in use for printing. On the other hand, in a case where the corresponding sheet cassette is in use for printing, the sheet cassette corresponding to the pressed button 202 is not drawn out. Accordingly, the sheet cassette is prevented from being drawn out to induce a jammed sheet during sheets to be used in printing are being fed.

As illustrated in FIG. 2, each sheet cassette includes a sheet display unit 201, a button 202, a lamp 203, and an indicator 204.

The sheet display unit 201 displays a size and type of sheets stored in each of the sheet cassettes 103 through 107. The user may put a seal indicating the size and type of the sheets in the sheet cassette to the display unit 201, so that a user can recognize which size and what type of sheets are stored in each sheet cassette afterwards. The button 202 for opening the sheet cassette is pressed by a user who desires to open the sheet cassette. When a user presses the button 202, a signal indicating the pressing of the button 202 is transmitted to the controller of the printing apparatus 101.

The lamp 203 indicates whether the sheet cassette is in use. The lamp 203 is turned ON in a case where the sheet cassette is in use for feeding sheet, whereas the lamp 203 is turned OFF in a case where the sheet cassette is not in use for feeding sheets. While the lamp 203 is ON, the sheet cassette cannot be opened even if a user presses the button 202. On the other hand, while the lamp 203 is OFF, the sheet cassette is opened when a user presses the button 202.

The indicator 204 indicates a remaining amount of sheets stored in the sheet cassette. The sheet cassette is configured such that the remaining amount of sheets set in the sheet cassette can be recognized by a sensor (not illustrated). The controller of the printing apparatus 101 displays the sheet remaining amount by increasing or decreasing tick marks of the indicator 204 according to the recognized sheet remaining amount. The indicator 204 indicates the remaining amount of sheets stored in the sheet cassette.

<Controlling Configuration of Printing Apparatus 101>

Figure 3:
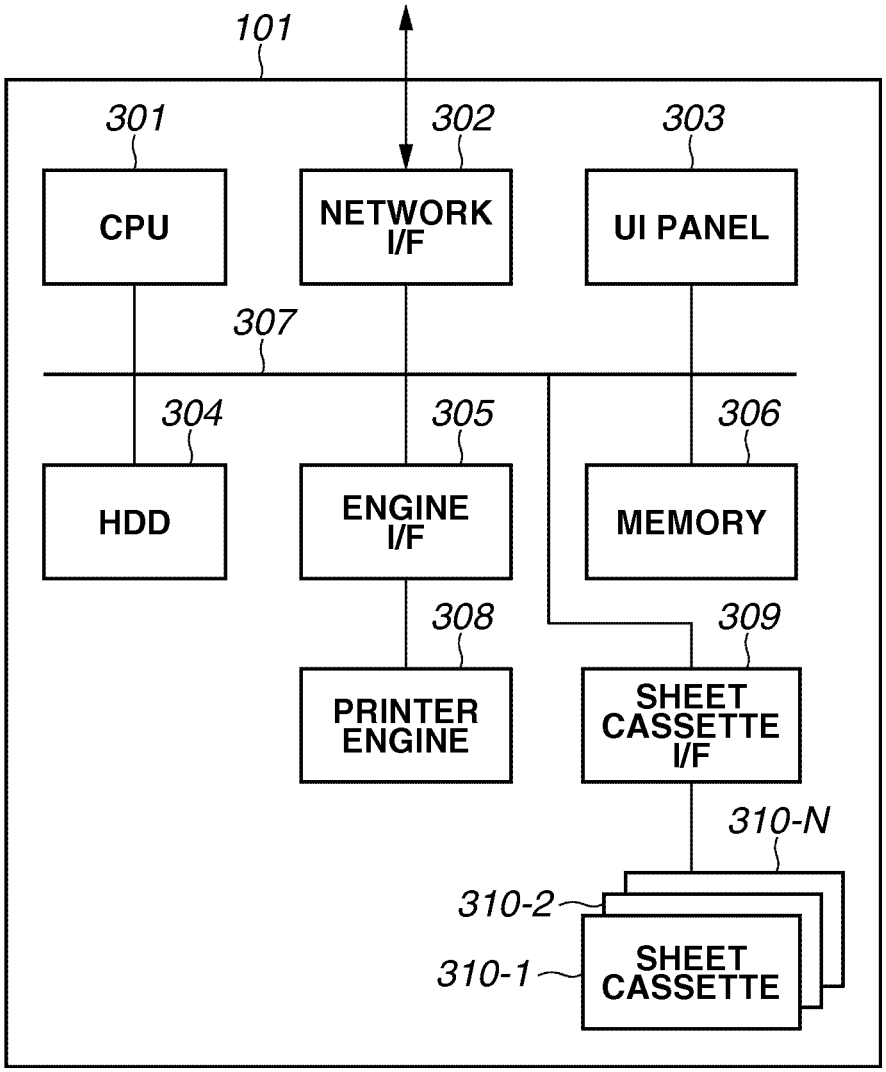
FIG. 3 is a block diagram illustrating a controlling configuration of the printing apparatus according to the exemplary embodiment.

FIG. 3 is a block diagram illustrating a controlling configuration of the printing apparatus 101 according to the present exemplary embodiment.

In FIG. 3, a central processing unit (CPU) 301 manages control of each unit within the printing apparatus 101 via a system bus 307, calculation, and execution of a program stored in a storage unit.

A memory 306 is used as a temporary storage area and a work memory while the printing apparatus 101 is operating. A hard disk drive (HDD) 304 is a large capacity storage unit and stores various types of control programs to be executed by the CPU 301. The HDD 304 is also used as a temporary storage area for data to be processed and a BOX region for storing data for each user. The HDD 304 further stores sheet information of sheets to be stored in each of the plurality of sheet cassettes. At the time, in a case where a user sets group information using a below described user interface (UI) screen, a group number corresponding to each sheet cassette is stored as the set group information.

In the HDD 304, a history of jamming (i.e., paper clogging) occurred in each sheet cassette is registered in association with identification (ID) of the sheet cassette as a sheet feeding source from which jamming is detected. Accordingly, the CPU 301 calculates an occurrence frequency of the sheet clogging based on the history of jamming registered in the HDD 304 and determines whether the calculated occurrence frequency exceeds a predetermined threshold.

A network interface (I/F) 302 enables the printing apparatus 101 to perform bidirectional communication with another data station such as a host computer via a network using a predetermined protocol.

An engine interface (I/F) 305 manages communication with a printer engine 308 and control of the printer engine 308. The printer engine 308 forms an image on a sheet by, for example, an electrophotographic process. A sheet cassette interface (I/F) 309 manages communication with a sheet cassette 310 and control of the sheet cassette 310. Sheet cassettes 310-1, 310-2, . . . and 310-N correspond to the sheet cassettes 103 through 107 illustrated in FIG. 1. A value "N" varies according to the number of sheet cassettes equipped to the printing apparatus 101. In a case where the printing apparatus 101 has a device configuration as illustrated in FIG. 1, the number of sheet cassettes N illustrated in FIG. 3 is five. A UI panel 303 corresponds to the UI panel 102 in FIG. 1.

The sheet cassette I/F 309 notifies the CPU 301 of a detection signal from a sensor for detecting the sheet remaining amount (i.e., a remaining amount detection sensor (not illustrated)) which is provided to each sheet cassette. Accordingly, the CPU 301 recognizes the remaining amount, or presence or absence of sheets in each sheet cassette.

<Software Module Configuration of Printing Apparatus 101>

Figure 4:
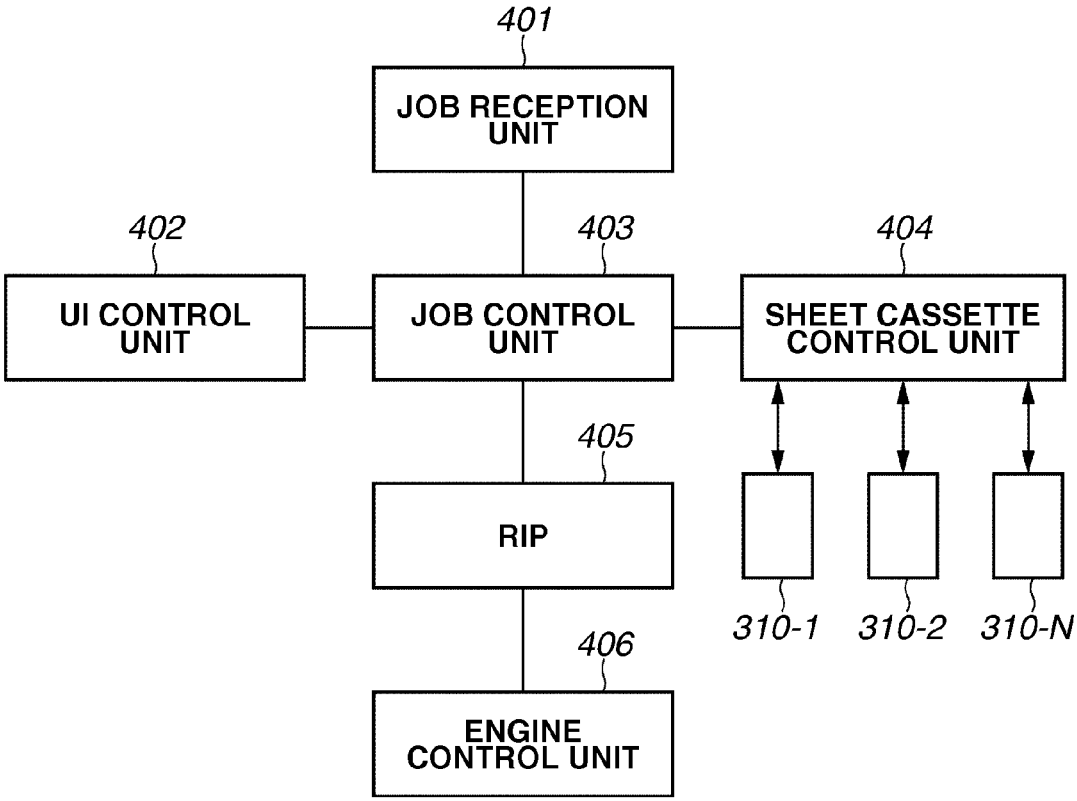
FIG. 4 is a block diagram illustrating a software module configuration of the printing apparatus.

FIG. 4 is a block diagram illustrating a software module configuration of the printing apparatus 101. The software module configuration exemplified here realizes functional processing corresponding to each module when the CPU 301 loads a program stored in the HDD 304 to the memory 306 and executes the program thereon. More specifically, each software module is developed on the memory 306 to be read out by the program. Thus, the read out program is executed on the CPU 301.

In FIG. 4, a job reception unit 401 receives a print job via the network interface (I/F) 302 and transfers the received print job to a job control unit 403. The job control unit 403 executes the print job and provides a sheet feeding instruction to a sheet cassette control unit 404. The job control unit 403 also instructs a UI control unit 402 to display a job state.

The UI control unit 402 displays the job state on the UI panel 303 according to the instruction received from the job control unit 403. The UI control unit 402 converts coordinate information representing a position where a user presses via a touch panel of the UI panel 303 into button information. Then, the UI control unit 402 transmits the button information to the job control unit 403.

The sheet cassette control unit 404 controls the sheet cassette I/F 309 to receive the remaining amount of sheets stored in each of the sheet cassettes 310-1 through 310-N and receive an opening or a closing state of each of the sheet cassettes 310-1 through 310-N. The sheet cassette control unit 404 locks and unlocks a specific sheet cassette based on an instruction from the job control unit 403.

The sheet cassette control unit 404 stops feeding sheets from the sheet cassette which runs out of sheets according to information notified from the sensor which detects running out of sheets by the instruction from the job control unit 403. The sheet cassette control unit 404 specifies a sheet cassette which stores sheets having the same attribute as the sheet information of sheets set to the sheet cassette. The sheet cassette control unit 404 switches the sheet cassette to be used in printing to the specified sheet cassette.

A raster image processor (RIP) 405 processes page description language (PDL) information of the received print job to generate a page image.

An engine control unit 406 transmits the page image generated by the RIP 405 to the printer engine 308 via the engine I/F 305 based on an instruction from the job control unit 403. The printer engine 308 forms an image of thus received page image on a sheet fed from the sheet cassette based on, for example, the electrophotographic process.

<Sheet Feeding Information Screen>

Figure 5:
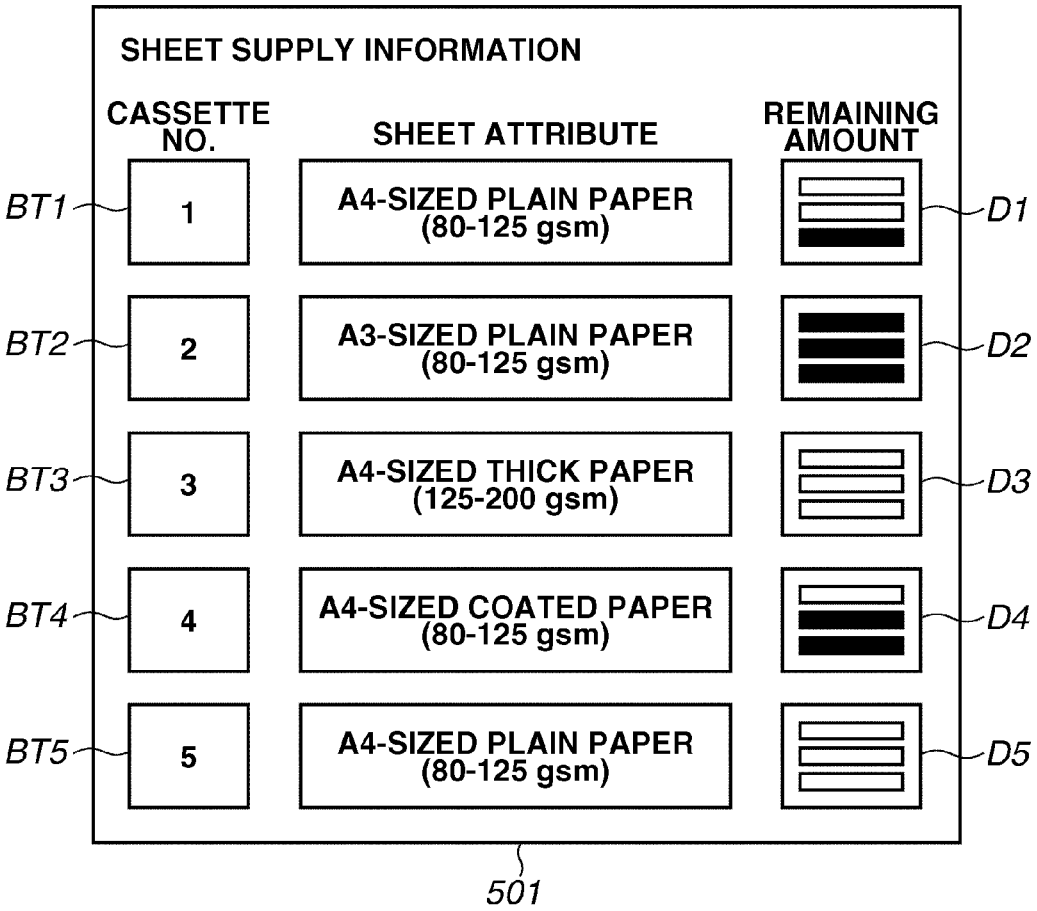
FIG. 5 illustrates an example of a user interface (UI) screen displayed on a UI panel illustrated in FIG. 3.

FIG. 5 illustrates an example of a user interface screen (i.e., UI screen) displayed on the UI panel 303 illustrated in FIG. 3. The UI screen exemplified here is a sheet feeding information screen of the sheet cassettes 310-1 through 310-5.

The sheet size and the sheet type (i.e., kinds) set to each of the sheet cassettes 310-1 through 310-5 are displayed on the UI panel 303. The sheet size and the sheet type are collectively referred to as a sheet attribute. The user can change the sheet size and the sheet type set to the sheet cassette by pressing buttons BT1 through BT5 corresponding to cassette numbers. The UI screen also displays indicators D1 through D5, each indicates the sheet remaining amount.

<First Sheet Feeding Control>

Figure 6:
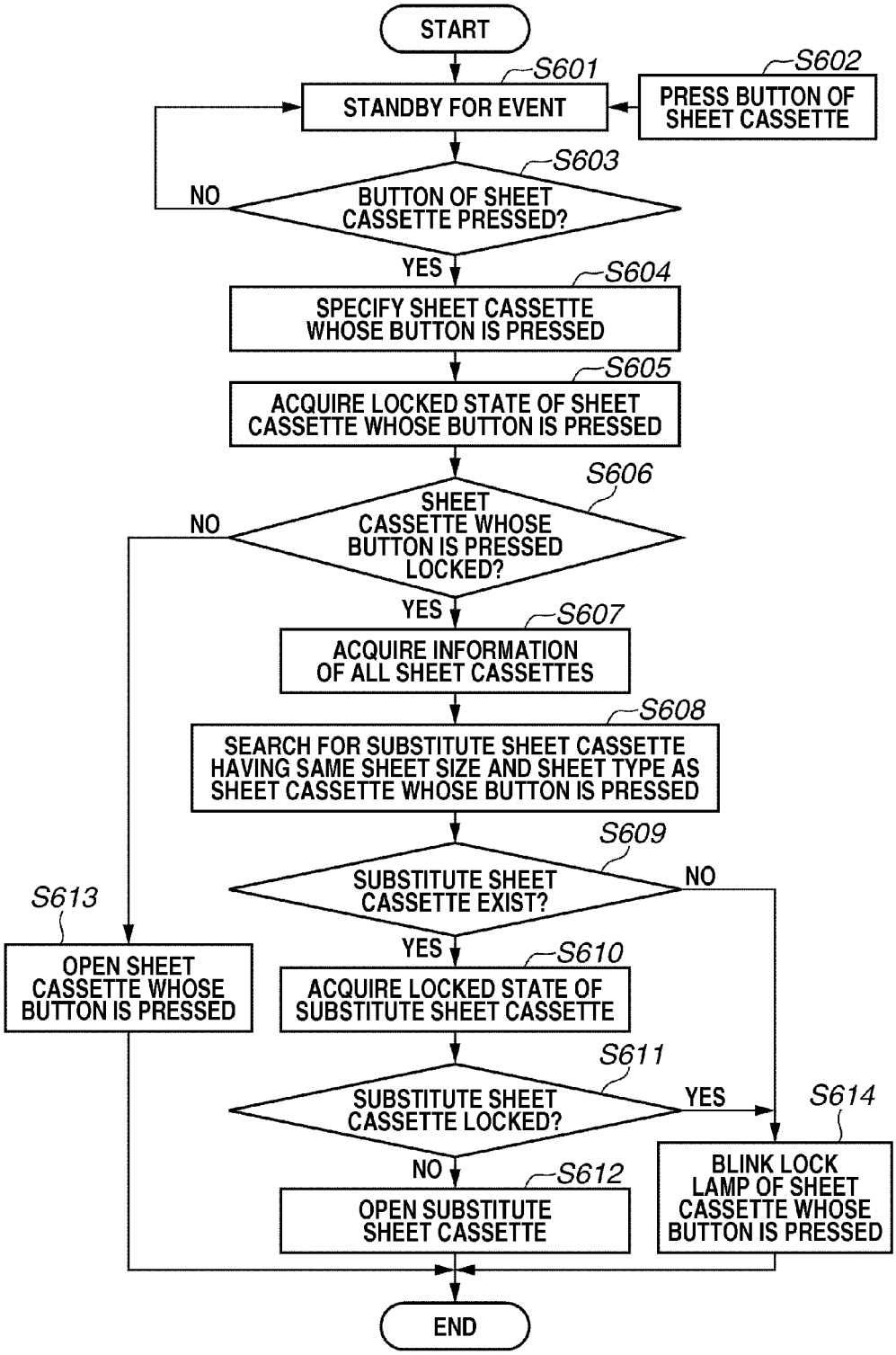
FIG. 6 is a flow chart illustrating a control method of the printing apparatus.

FIG. 6 is a flow chart illustrating a control method of the printing apparatus 101 according to the present exemplary embodiment. The control method exemplified here is control processing executed in a case where a button equipped on any one of the sheet cassettes is operated. Processing in each step is realized such that the CPU 301 reads out a program stored in the HDD 304 to the memory 306 to execute the program.

In step S601, the job control unit 403 is in an event standby state waiting for an event notified from a module such as the job reception unit 401, the UI control unit 402, the sheet cassette control unit 404, and so on.

In step S602, an event based on pressing of the button 202 provided on any one of the sheet cassettes 310-1 through 310-5 is notified from the sheet cassette control unit 404.

In step S603, the job control unit 403 determines whether the button 202 provided on any one of the sheet cassettes 310-1 through 310-5 is pressed. If the job control unit 403 determines that the button 202 provided on any one of the sheet cassettes 310-1 through 310-5 is not pressed (NO in step S603), the processing returns to step S601 and the job control unit 403 comes to be the event standby state again.

On the other hand, in step S603, if the job control unit 403 determines that the button 202 provided on any one of the sheet cassettes 310-1 through 310-5 is pressed (YES in step S603), the processing proceeds to step S604. In step S604, the job control unit 403 inquires of the sheet cassette control unit 404 the number of the sheet cassette of which button 202 is pressed. The job control unit 403 specifies the sheet cassette of which button 202 is pressed from the sheet cassette number responded from the sheet cassette control unit 404.

In step S605, the job control unit 403 inquires of the sheet cassette control unit 404 a locked state of the sheet cassette of which button 202 is pressed to acquire the locked state information responded from the sheet cassette control unit 404.

In step S606, the job control unit 403 acquires information from the sheet cassette control unit 404 and determines whether the sheet cassette of which button 202 is pressed is in the locked state. More specifically, the job control unit 403 determines whether the sheet cassette of which button 202 is pressed is in a state which does not allow supply of sheets or confirmation thereof.

If the job control unit 403 determines that the sheet cassette of which button 202 is pressed is not in the locked state (NO in step S606), in step S613, the job control unit 403 instructs the sheet cassette control unit 404 to open the sheet cassette of which button 202 is pressed. Accordingly, the sheet cassette control unit 404 releases the locked state of the sheet cassette of which button 202 is pressed and puts the sheet cassette in an unlocked state. Accordingly, the sheet cassette is opened.

A method for opening the sheet cassette may be configured such that, in a case where the sheet cassette is a draw-out type, the sheet cassette can be pushed out to open with use of a pushing mechanism (not illustrated). On the other hand, in a case where the sheet cassette has a door, the sheet cassette can be opened by opening the door. Therefore, a user can confirm presence or absence of sheets in the relevant sheet cassette and can supply sheets with ease in this state, even if the engine control unit 406 is during the print processing. The print processing includes processing of feeding sheets from the other sheet cassette to perform the print processing.

In step S606, if the job control unit 403 determines that the sheet cassette of which button 202 is pressed is in the locked state (YES in step S606), the processing proceeds to step S607. In step S607, the job control unit 403 inquires of the sheet cassette control unit 404 about information pieces of the sheet size, the sheet type, and the sheet remaining amount of all the sheet cassettes. Accordingly, the job control unit 403 acquires information pieces responded from the respective sheet cassettes.

In step S608, the job control unit 403 conducts the following search based on the acquired information pieces of all the sheet cassettes. More specifically, the job control unit 403 conducts a search as to whether there is a substitute sheet cassette storing sheets of which sheet size and sheet type conform to those of the sheets set in the sheet cassette of which button 202 is pressed, in addition to the sheet cassette of which button 202 is pressed.

In step S609, the job control unit 403 determines whether there is the substitute sheet cassette.

In step S609, if the job control unit 403 determines that there is no substitute sheet cassette (NO in step S609), then in step S614, the job control unit 403 instructs the sheet cassette control unit 404 to blink a lock lamp 203 of the sheet cassette of which button 202 is pressed. Upon receiving the instruction, the lock lamp 203 of the sheet cassette blinks. Accordingly, a user can confirm that there is no substitute sheet cassette for the locked sheet cassette.

On the other hand, in step S609, if the job control unit 403 determines that there is the substitute sheet cassette (YES in step S609), the processing proceeds to step S610. In step S610, the job control unit 403 inquires of the sheet cassette control unit 404 a locked state of the substitute sheet cassette and acquires response information thereof.

In step S611, the job control unit 403 determines whether a state of the substitute sheet cassette responded from the sheet cassette control unit 404 is the locked state. In step S611, if the job control unit 403 determines that the substitute sheet cassette is in the locked state (YES in step S611), then in step S614, the job control unit 403 instructs the sheet cassette control unit 404 to blink the lock lamp 203 of the sheet cassette of which button 202. Upon receiving the instruction, the lock lamp 203 of the sheet cassette blinks and the present processing is ended. Accordingly, a user can visually confirm that there is no substitute sheet cassette which is not in use among the locked sheet cassettes.

On the other hand, in step S611, if the job control unit 403 determines that the substitute sheet cassette is not locked (NO in step S611), the processing proceeds to step S612. In step S612, the job control unit 403 instructs the sheet cassette control unit 404 to open the substitute sheet cassette and opens the sheet cassette. Then, the present processing is ended. Accordingly, a user can supply sheets required in executing a job to thus opened sheet cassette as the substitute sheet cassette for the sheet cassette of which button 202 is pressed.

According to the present exemplary embodiment, if a user performs just an easy operation to press the button 202 of the sheet cassette which is in use and locked, the user can securely confirm the substitute sheet cassette without operating the UI panel 303. Therefore, a suitable substitute sheet cassette specified by pressed the button 202 by the user is opened to allow the user to supply proper sheets to the substitute sheet cassette. Accordingly, if the sheets stored in the sheet cassette in use for printing runs out, the sheet cassette can be switched to the other sheet cassette to which sheets are supplied. As a result, printing can be continued as much as possible without stopping the printing processing.

In the above-described first exemplary embodiment, a description is made as to processing for selecting a sheet cassette storing sheets having the same sheet size and sheet type as the sheets stored in the sheet cassette of which button 202 is pressed as a substitute sheet cassette. In addition to that, a sheet cassette among the sheet cassettes which are grouped may be selected as the substitute sheet cassette. According to a second exemplary embodiment, processing for selecting a substitute sheet cassette among the grouped sheet cassettes is described.

<Grouping of Sheet Cassettes>

According to the present exemplary embodiment, the grouping of the sheet cassettes means that a plurality of sheet cassettes are collectively considered as a virtual group. Generally, in a case of a print job in which a sheet cassette is designated, if sheets stored in the designated sheet cassette runs out, the printing apparatus 101 stops printing and displays a message for prompting a user to supply sheets to the sheet cassette designated on the UI panel 102. On the other hand, if the sheet cassettes are grouped, when the sheets stored in the designated sheet cassette runs out, an automatic cassette change (ACC) for continuing the printing if there are printable sheets stored in the other sheet cassette belonging to the same group is executed.

Figure 7:
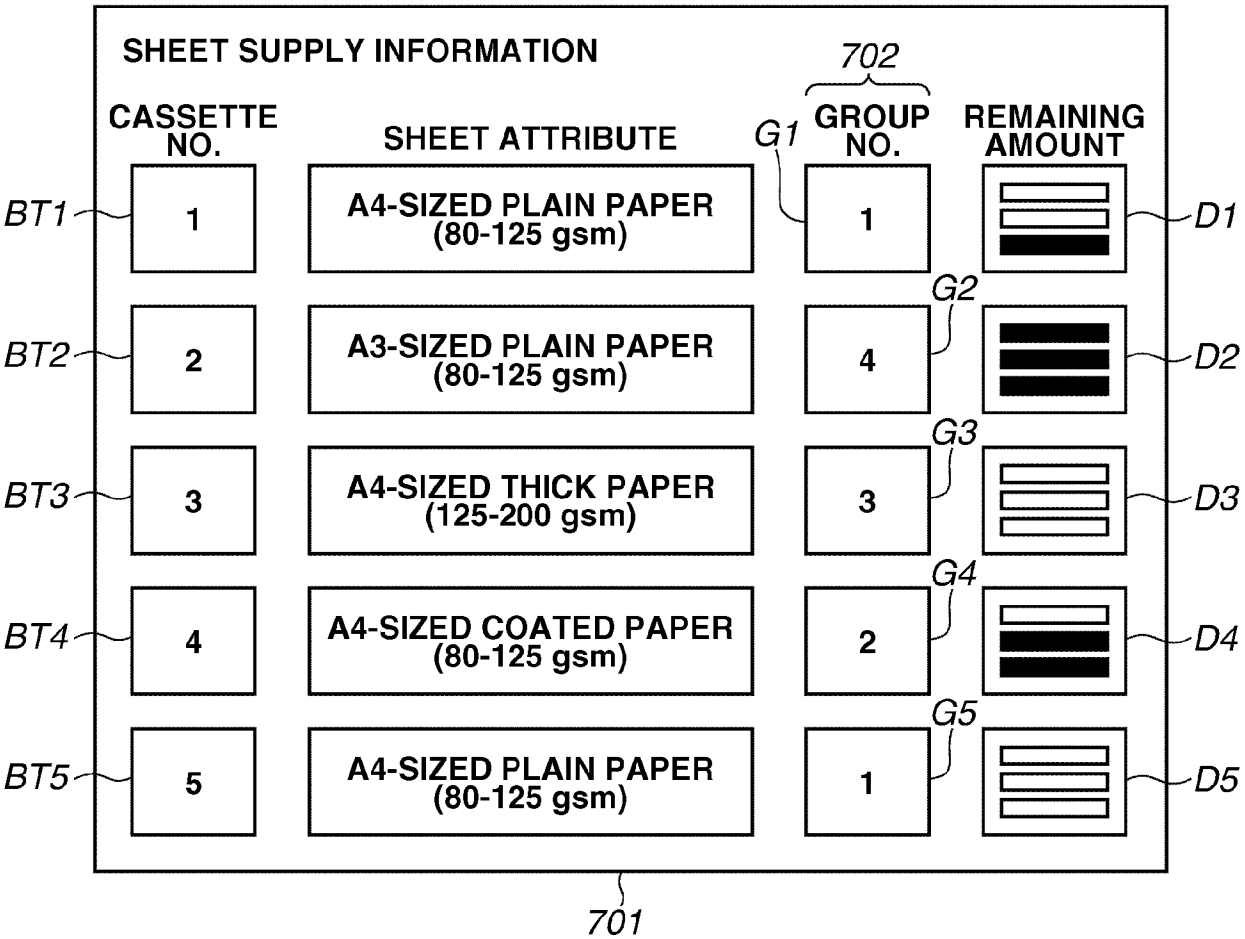
FIG. 7 illustrates an example of a UI screen displayed on the UI panel illustrated in FIG. 3.

FIG. 7 illustrates an example of a user interface screen (i.e., UI screen) displayed on the UI panel 303 illustrated in FIG. 3. The user interface screen exemplified here is a setting screen for grouping the sheet cassettes displayed on the UI panel 303. Components identical to those in FIG. 5 are provided with the same reference numerals, and descriptions thereof are omitted. In FIG. 7, a grouping setting button 702 indicates a group to which each sheet cassette belongs. In the present exemplified UI screen, sheet cassettes No. 1 and No. 5 belong to a group 1, a sheet cassette No. 4 belongs to a group 2, a sheet cassette No. 3 belongs to a group 3, and a sheet cassette No. 2 belongs to a group 4.

Figure 8:
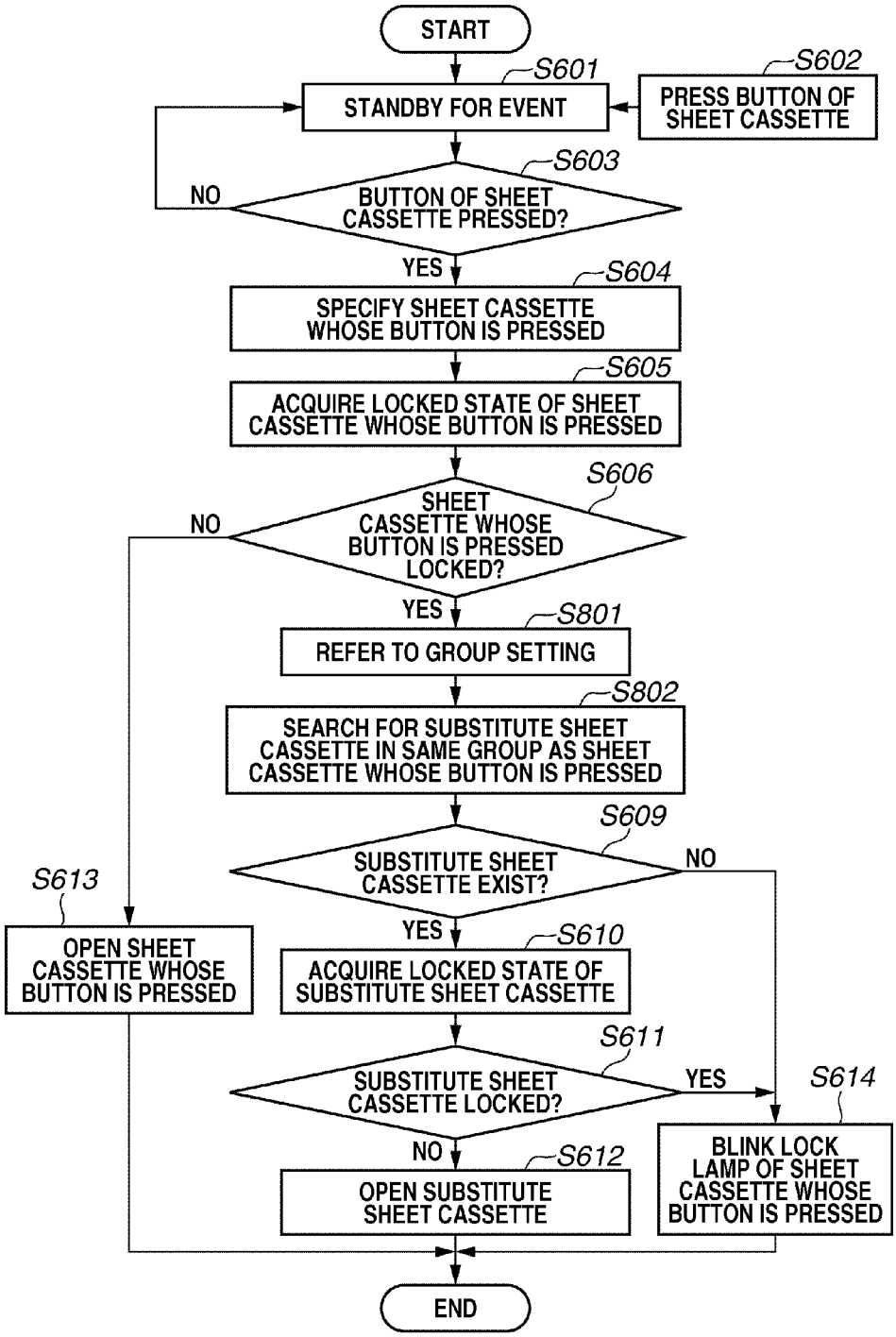
FIG. 8 is a flow chart illustrating a control method of the printing apparatus.

FIG. 8 is a flow chart illustrating a control method of the printing apparatus 101 according to the present exemplified embodiment. The control method exemplified here is control processing executed in a case where the button equipped on any one of the sheet cassettes is operated. Processing in each step is realized such that the CPU 301 reads out a program stored in the HDD 304 to the memory 306 to execute the program.

After the job control unit 403 starts control processing, the processing in steps S601 through S606 and the processing in steps S609 through S614 are performed in a manner similar to those performed in the corresponding steps in FIG. 6 according to the first exemplary embodiment. Processing in steps S801 and S802 characterized in the present exemplary embodiment are described below.

In step S606, if the job control unit 403 determines that the sheet cassette of which button 202 is pressed is locked (YES in step S606), then in step S801, the job control unit 403 acquires group setting information of the sheet cassettes, which is set in advance, from the HDD 304.

In step S802, the job control unit 403 conducts a search as to whether there is a substitute sheet cassette belonging to the same group of the sheet cassette of which button 202 is pressed other than the sheet cassette of which button 202 is pressed from the group setting information of the sheet cassettes acquired from the HDD 304.

In step S609, the job control unit 403 determines whether there is the substitute sheet cassette. The processing in steps S610 through S614 is similar to that performed in the first exemplified embodiment.

According to the present exemplary embodiment, if a user can presses the button 202 of the locked sheet cassette, the substitute sheet cassette appropriately grouped can be opened without operating the UI panel 303. Accordingly, the user can properly supply sheets to the substitute sheet cassette which is specified in the same group thereof. Accordingly, if the sheets stored in the sheet cassette in use for printing runs out, the sheet cassette can be switched to the other sheet cassette to which sheets are supplied. As a result, printing can be continued as much as possible without stopping the printing processing.

In the first and the second exemplary embodiments, the processing for specifying and selecting a substitute sheet cassette for the sheet cassette of which button 202 is pressed is described. However, in a case of the printing apparatus equipped with many sheet cassettes, a substitutable sheet cassette is not always limited to one. According to a third exemplary embodiment, a control method in a case where there is a plurality of substitutable sheet cassettes is described.

Figure 9:
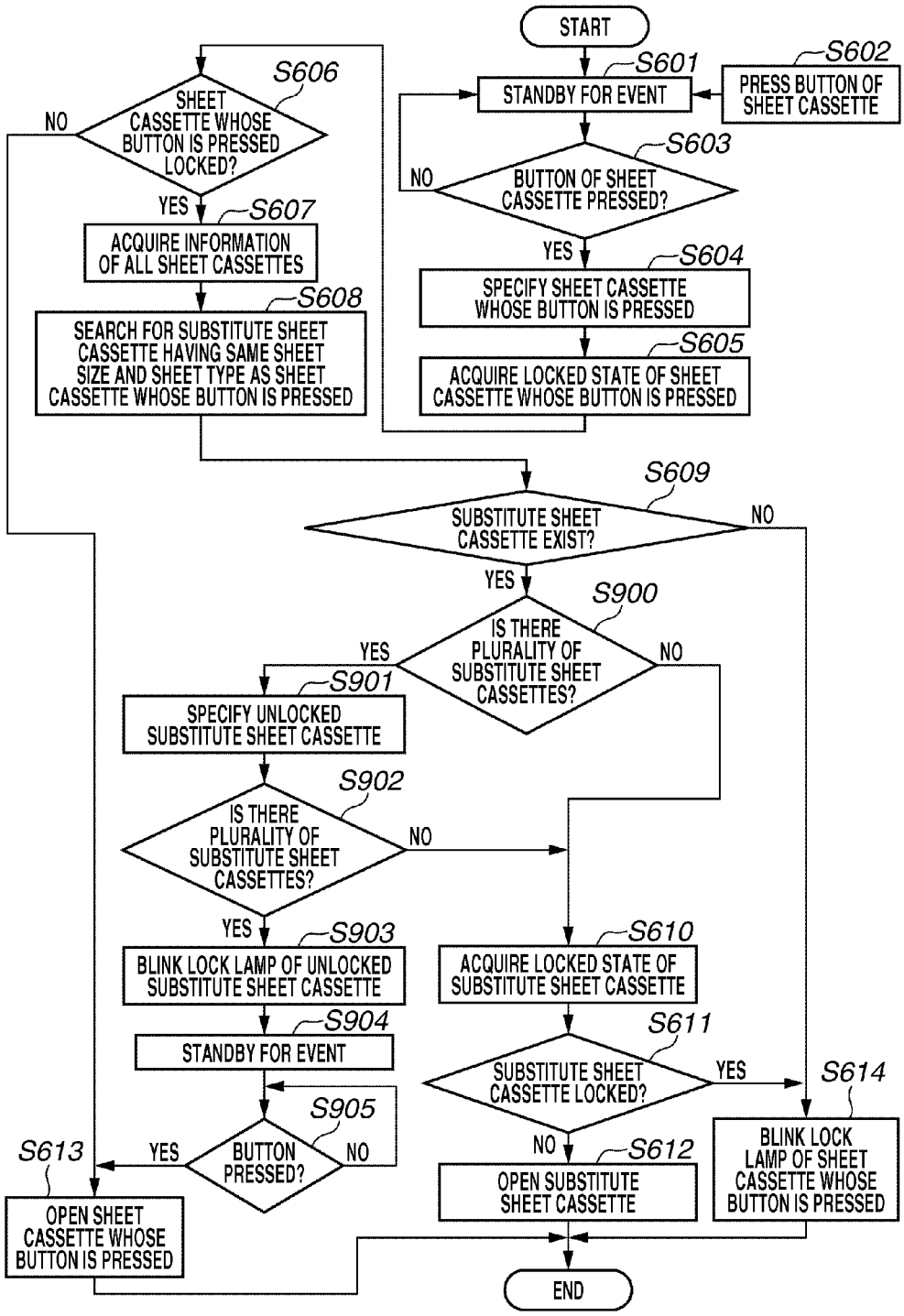
FIG. 9 is a flow chart illustrating a control method of the printing apparatus.

FIG. 9 is a flow chart illustrating a control method of the printing apparatus 101 according to the present exemplary embodiment. The control method exemplified here is control processing executed in a case where the button equipped on any one of the sheet cassettes is operated. Processing in each step is realized such that the CPU 301 reads out a program stored in the HDD 304 to the memory 306 to execute the program.

After the job control unit 403 starts the control processing, the processing in steps S601 through S609 is performed in a manner similar to that in FIG. 6 according to the first exemplary embodiment. Processing in steps S900 through S905 characterized in the present exemplary embodiment is described below.

In step S609, the job control unit 403 determines whether there is a substitute sheet cassette.

In step S609, if the job control unit 403 can find out a substitute sheet cassette (YES in step S609), then in step S900, the job control unit 403 determines whether there is a plurality of the substitute sheet cassettes. If the job control unit 403 determines that there is not a plurality of the substitute sheet cassettes (NO in step S900), the job control unit 403 performs processing in steps S610 through S614 in a manner similar to the processing performed in the first exemplary embodiment. Then, the present processing is ended.

On the other hand, if the job control unit 403 determines that there is a plurality of the substitute sheet cassettes (YES in step S900), the job control unit 403 advances the processing to step S901. In step S901, the job control unit 403 inquires of the sheet cassette control unit 404 about a locked state of each of the plurality of substitutable sheet cassettes to specify an unlocked substitute sheet cassette.

In step S902, the job control unit 403 determines whether there is a plurality of the specified unlocked substitute sheet cassettes. If the job control unit 403 determines that there are not a plurality of unlocked substitute sheet cassettes (NO in step S902), the processing insteps S610 through S614 is performed in a manner similar to that in the first exemplary embodiment. Then, the present processing is ended.

On the other hand, if the job control unit 403 determines that there is a plurality of unlocked substitute sheet cassettes (YES in step S902), then in step S903, the job control unit 403 causes lock lamps 203 of the plurality of unlocked substitute sheet cassettes to blink. Accordingly, a user of the printing apparatus 101 can easily confirm which sheet cassette is ready for feeding sheets other than the sheet cassette of which button 202 is pressed from the display states of the sheet cassettes without moving to a position of the UI panel 303.

In step S904, the job control unit 403 comes to be an event standby state in a manner similar to step S601 and waits for a user to press the button 202 of the sheet cassettes of which lock lamps 203 blink.

In step S905, if the job control unit 403 determines that the button 202 of the specific sheet cassette is pressed by the user (YES in step S905), the processing proceeds to step S613 where the job control unit 403 allows the sheet cassette of which button 202 is pressed to open and to make the sheet cassette possible to be drawn out. Then, the present processing is ended.

According to the present exemplary embodiment, a user can select proper sheet cassettes to which sheets are supplied at the position of the sheet cassettes by confirming blinking of the lock lamps 203 of the proper substitute sheet cassettes without operating the UI panel 303.

In the above-described third exemplary embodiment, similar to the first exemplary embodiment, the control processing is described in which sheet cassettes storing sheets having the same sheet size and sheet type as the sheets stored in the sheet cassette of which buttons 202 is pressed are selected as substitute sheet cassettes and a plurality of lock lamps 203 thereof are caused to blink. As a fourth exemplary embodiment, a means for causing a plurality of lock lamps 203 to blink can be applied to a case where there is a plurality of sheet cassettes grouped in the second exemplary embodiment.

In the above-described third exemplary embodiment, the control processing is described in which, if the button 202 of the sheet cassette is pressed, the sheet cassettes storing sheets having the same sheet size and sheet type as the sheets stored in the sheet cassette of which buttons 202 is pressed are selected as substitute sheet cassettes and a plurality of lock lamps 203 thereof is caused to blink. According to a fifth exemplary embodiment, control processing is described in which an appropriate substitute sheet cassette is automatically opened and a door of the sheet cassette is opened without causing the lock lamp 203 thereof to blink, as similar to the first exemplary embodiment.

Figure 10:
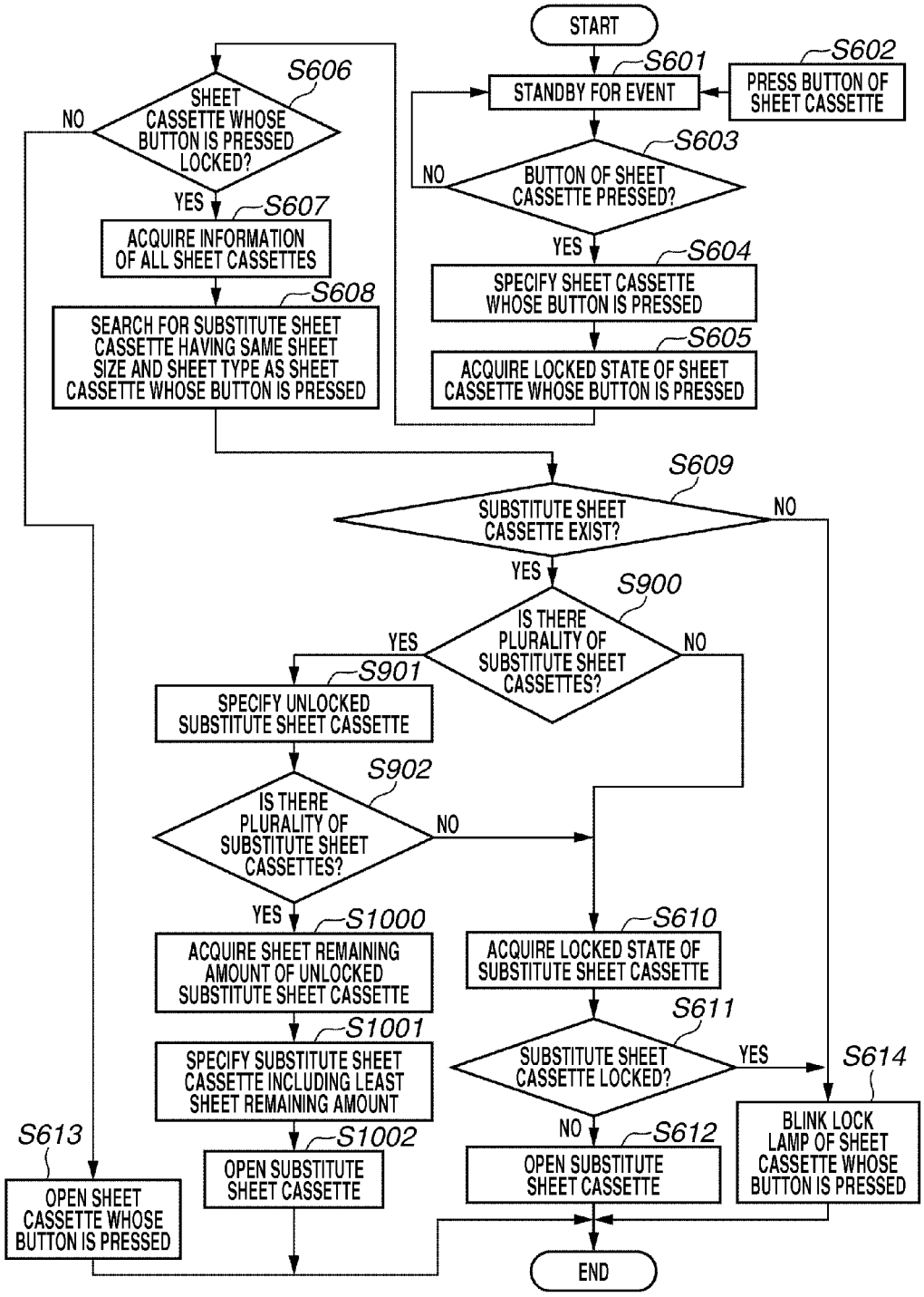
FIG. 10 is a flow chart illustrating a control method of the printing apparatus.

FIG. 10 is a flow chart illustrating a control method of the printing apparatus 101 according to the present exemplary embodiment. The control method exemplified here is control processing executed in a case where the button equipped on any one of the sheet cassettes is operated. Processing in each step is realized such that the CPU 301 reads out a program stored in the HDD 304 to the memory 306 to execute the program. After the job control unit 403 starts control processing, control processing in steps S601 through S902 is performed in a manner similar to that in the third exemplary embodiment.

In step S902, if the job control unit 403 determines that there is a plurality of the specified unlocked substitute sheet cassettes (YES in step S902), the processing proceeds to step S1000.

In step S1000, the job control unit 403 acquires remaining amount information of sheets stored in the plurality of the specified substitute sheet cassettes from the sheet cassette control unit 404. In step S1001, the job control unit 403 refers to the remaining amount information of the substitute sheet cassettes acquired from the sheet cassette control unit 404 to specify a substitute sheet cassette storing the least remaining amount of sheets.

In step S1002, the job control unit 403 instructs the sheet cassette control unit 404 to open the substitute sheet cassette specified in step S1001. Then, the present processing is ended.

According to the present exemplary embodiment, a user can specify the substitute sheet cassettes without moving to the position of the UI panel 303. Therefore, the user is no longer required to move all the way to the UI panel 303 to confirm a content of the UI panel 303. In other words, the user can open the proper substitute sheet cassette with a simple operation to press the button 202 of the sheet cassette which is in use and locked, and supply sheets as required. As a result, a sheet supply operation can be performed effectively.

In the above-described fifth exemplary embodiment, as similar to the first exemplary embodiment, the sheet cassettes storing sheets having the same sheet size and sheet type as the sheets stored in the sheet cassette of which button 202 is pressed are selected as substitute sheet cassettes. Then, the sheet cassette storing the least sheet remaining amount of sheets is selected and opened based on the sheet remaining amount information of the plurality of sheet cassettes.

As a sixth exemplary embodiment, if there is a plurality of sheet cassettes grouped according to the second exemplary embodiment, control processing for selecting and opening the sheet cassette storing the least sheet remaining amount of sheets based on the sheet remaining amount information of the plurality of sheet cassettes can be executed in a similar manner.

In the first through sixth exemplary embodiments, the control processing is described in which a sheet cassette storing sheets having the same sheet size and sheet type or a grouped sheet cassette is selected with no condition as a substitute sheet cassette. However, in an actual operation of the printing apparatus 101, an occurrence frequency of sheet clogging (i.e., jamming) may become higher only with a specific sheet cassette due to physical factors such as a state of a sheet feeding roller of a sheet cassette and a cleaning state of a sheet feeding path. According to a below-described seventh exemplary embodiment, control processing is added to the first exemplary embodiment such that a sheet cassette in which jamming occurs frequently is not selected as a substitute sheet cassette.

Figure 11:
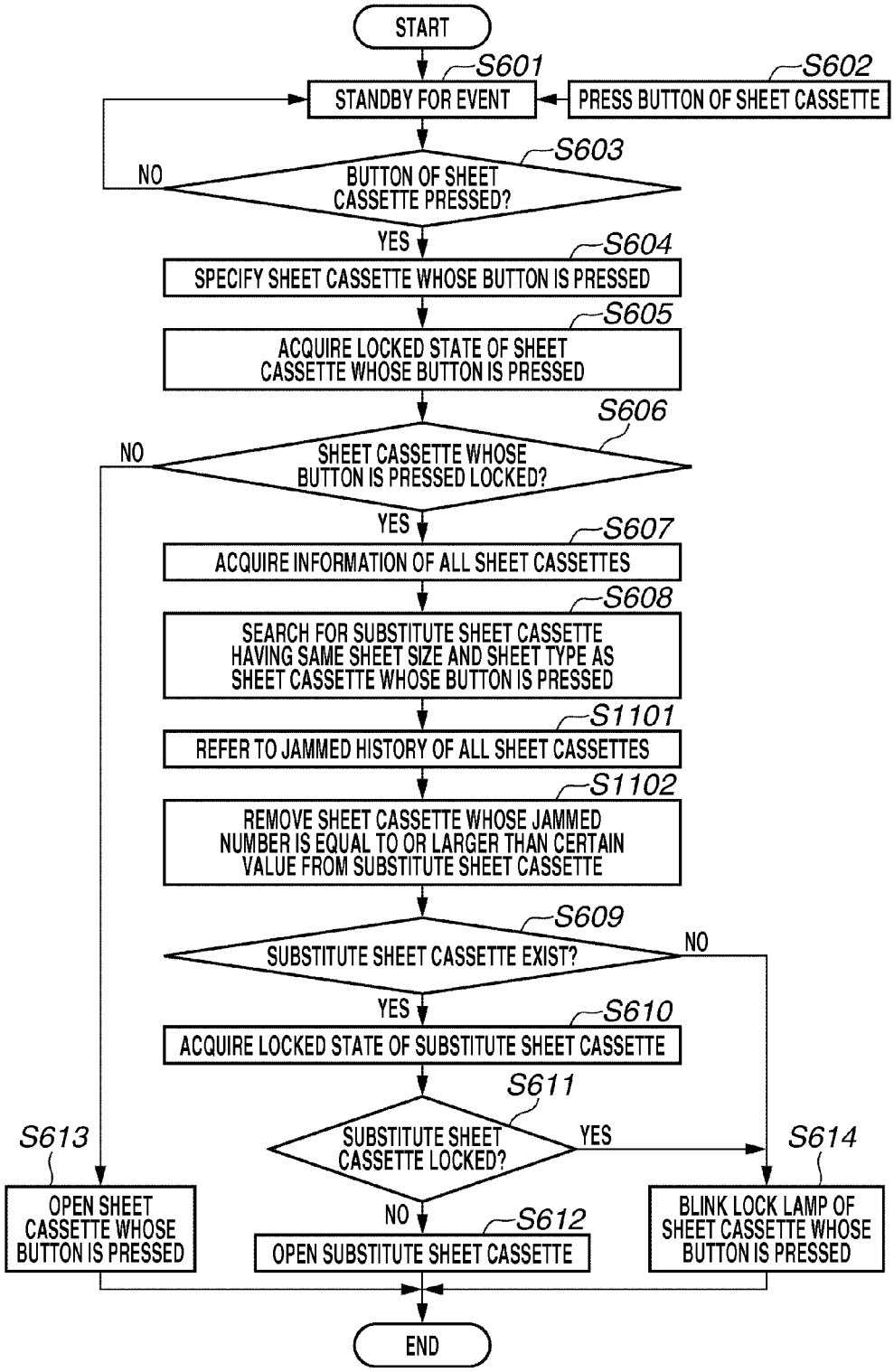
FIG. 11 is a flow chart illustrating a control method of the printing apparatus.

FIG. 11 is a flow chart illustrating a control method of the printing apparatus 101 according to the present exemplary embodiment. The control method exemplified here is control processing executed in a case where the button equipped on any one of the sheet cassettes is operated. Processing in each step is realized such that the CPU 301 reads out a program stored in the HDD 304 to the memory 306 to execute the program. After the job control unit 403 starts control processing, control processing in steps S601 through S608 is performed in a manner similar to that in the third exemplary embodiment.

In step S1101, the job control unit 403 refers to a jam history of each sheet cassette stored in the HDD 304 or the memory 306.

In step S1102, the job control unit 403 refers to a jam history with respect to each substitutable sheet cassette searched in step S608. The job control unit 403 removes the substitute sheet cassettes in which the number of jams is larger than a threshold set in advance and stored in the HDD 304 or the memory 306 from selection candidates for the substitute sheet cassette. Then in step S609 and subsequent steps, the job control unit 403 performs control processing similar to that in the first exemplary embodiment.

According to the present exemplary embodiment, the sheet cassette of a higher jamming rate can be removed from the selection candidates for the substitutable sheet cassettes. Therefore, the sheet cassette having a higher jam occurrence frequency can be prevented from being selected as a substitute sheet cassette.

In the seventh exemplary embodiment, the control processing for removing the sheet cassette of a higher jamming rate from the selection candidates of the substitutable sheet cassettes is described based on the first exemplary embodiment. In addition, as an eighth exemplary embodiment, the seventh exemplary embodiment can be applied to the second through the sixth exemplary embodiments.

In the above-described first to eighth exemplary embodiments, the control processing is described in which, when a user presses the button 202 of the locked sheet cassette, the substitute sheet cassette for the relevant sheet cassette is opened. However, as a ninth exemplary embodiment, the printing apparatus may be configured to perform control, when a user presses the button 202 of the locked sheet cassette, to shift a sheet feeding destination for feeding sheets to the substitute sheet cassette to unlocking the sheet cassette of which button 202 is pressed and to open a door thereof. The ninth exemplary embodiment is described below.

Figure 12:
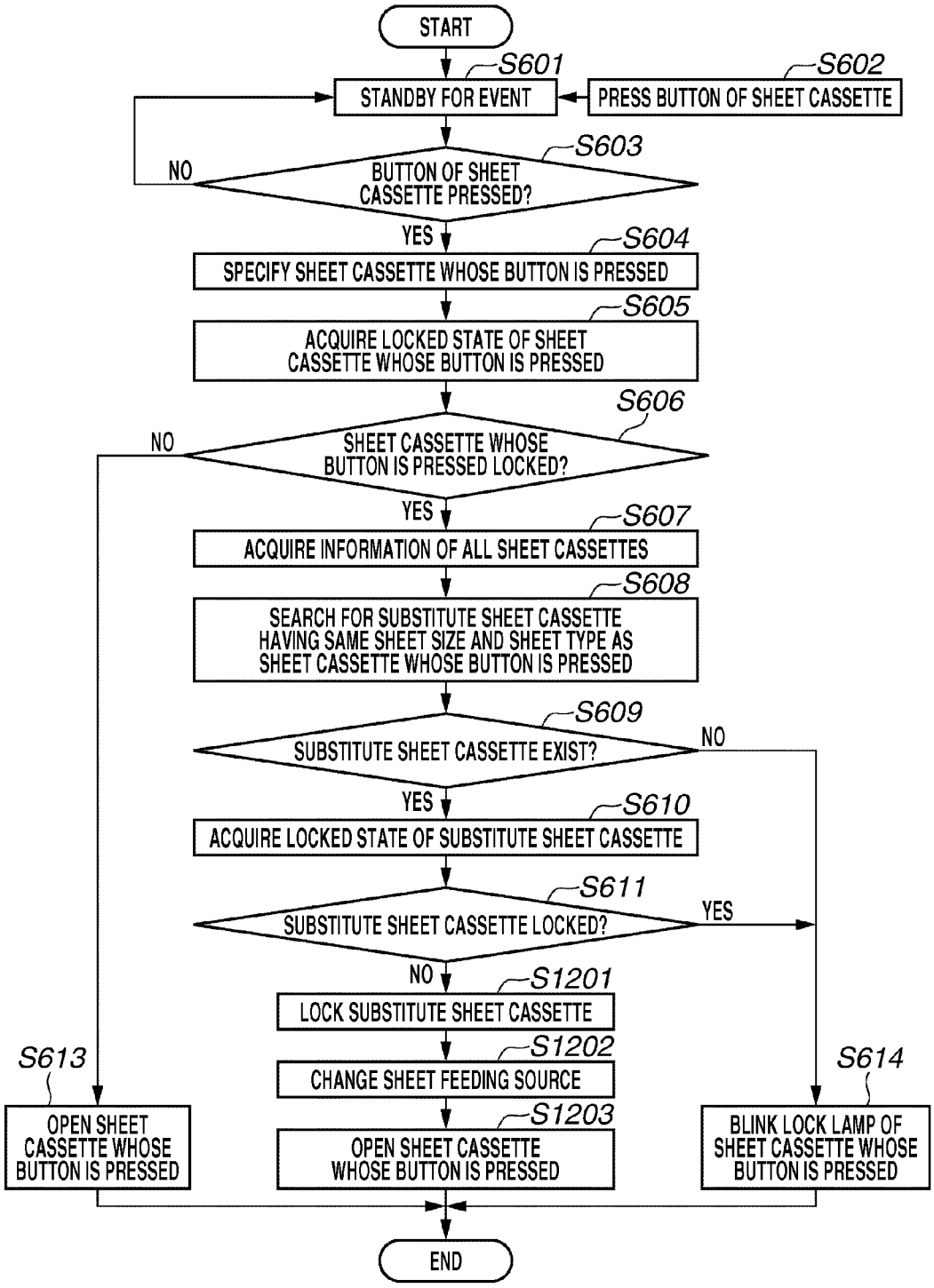
FIG. 12 is a flow chart illustrating a control method of the printing apparatus.

FIG. 12 is a flow chart illustrating a control method of the printing apparatus 101 according to the present exemplary embodiment. The control method exemplified here is control processing executed in a case where the button equipped on any one of the sheet cassettes is operated. Processing in each step is realized such that the CPU 301 reads out a program stored in the HDD 304 to the memory 306 to execute the program. After the job control unit 403 starts control processing, control processing in steps S601 through S611 is performed in a manner similar to that in the first exemplary embodiment.

In step S611, if the job control unit 403 determines that the substitute sheet cassette is not locked (NO in step S611), then in step S1201, the job control unit 403 locks the substitute sheet cassette. In step S1202, the job control unit 403 instructs the sheet cassette control unit 404 to change a sheet feeding source from the sheet cassette that is currently feeding sheets and of which button 202 is pressed to a substitute sheet cassette. In step S1203, the job control unit 403 opens the sheet cassette of which button 202 is pressed. Then, the present processing is ended.

According to the present exemplary embodiment, if the sheet cassette from which a user wants to supply sheets is in use, the sheet feeding source can be shifted to the substitute sheet cassette and the user can supply sheets to the sheet cassette from which the user wants to feed sheets.

In the above-described ninth exemplary embodiment, the control processing is described in which, when a user presses the button 202 for opening the locked sheet cassette based on the processing in the first exemplary embodiment, the sheet feeding source is shifted to a substitute sheet cassette and the sheet cassette of which button 202 is pressed is opened. As a tenth exemplary embodiment, the ninth exemplary embodiment can be applied to the above-described second to eighth exemplary embodiments.

In the first through tenth exemplary embodiments, the control processing for opening a substitute sheet cassette when a user presses the button 202 of the locked sheet cassette is described. Alternatively, the control processing is described in which the sheet feeding source is changed and the sheet cassette of which button 202 is pressed is unlocked to open a door of the sheet cassette. According to an eleventh exemplary embodiment, control processing is described in which a substitute sheet cassette is automatically opened according to a remaining amount of a deck even without an explicit instruction of a user.

Figure 13:
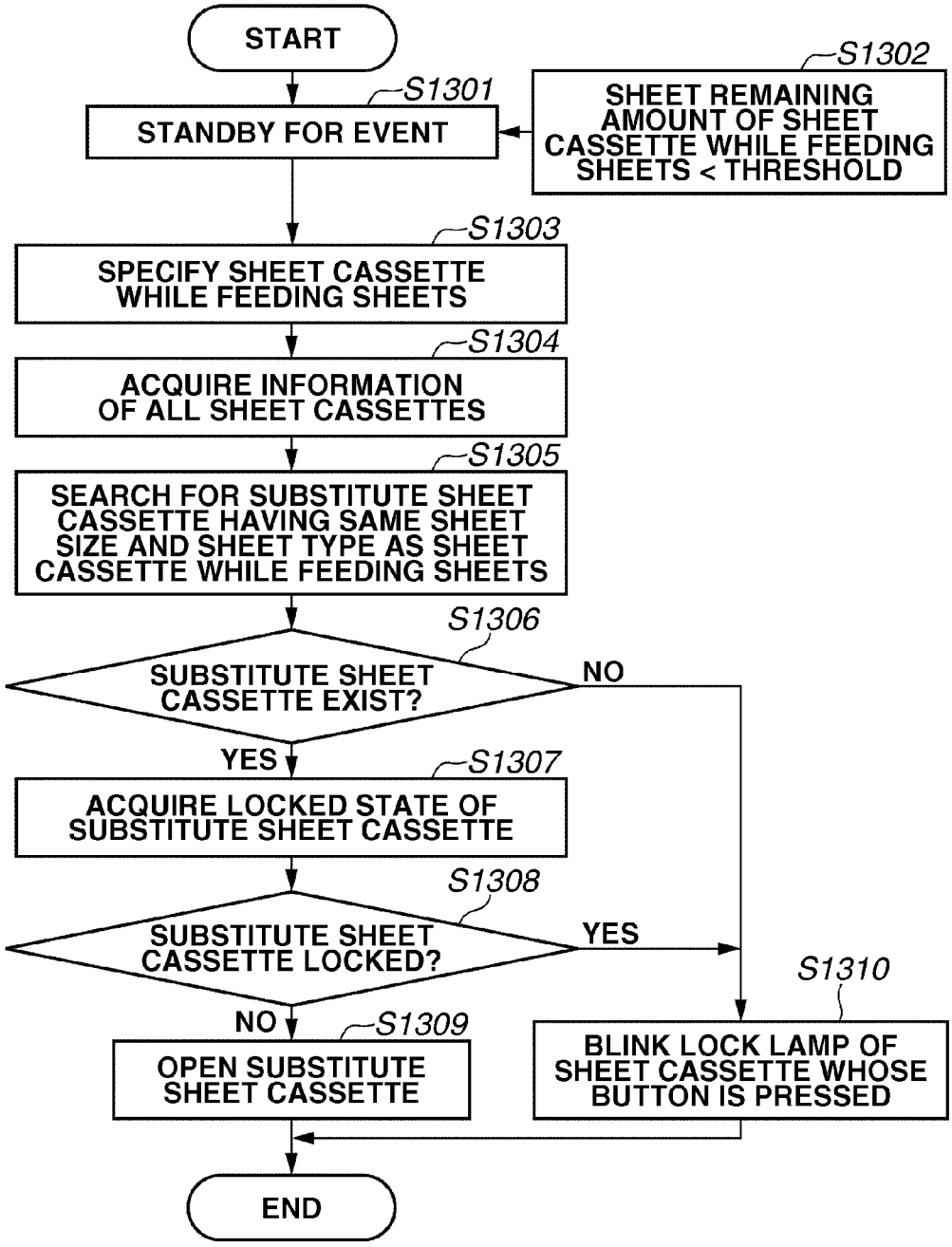
FIG. 13 is a flow chart illustrating a control method of the printing apparatus.

FIG. 13 is a flow chart illustrating a control method of the printing apparatus 101 according to the present exemplary embodiment. The control method exemplified here is control processing executed in a case where the button equipped on any one of the sheet cassettes is operated. Processing in each step is realized such that the CPU 301 reads out a program stored in the HDD 304 to the memory 306 to execute the program.

After the job control unit 403 starts control processing, in step S1301, the job control unit 403 is in an event standby state as described above in which the job control unit 403 waits for an event notified from a module such as the job reception unit 401, the UI control unit 402, and the sheet cassette control unit 404. In step S1302, the job control unit 403 is notified from the sheet cassette control unit 404 an event indicating that a sheet remaining amount in the sheet cassette becomes less than a threshold stored in advance in the HDD 304 or the memory 306.

In step S1303, the job control unit 403 acquires from the sheet cassette control unit 404 sheet cassette information indicating that the sheet remaining amount becomes less than the threshold, and specifies the relevant sheet cassette.

In step S1304, the job control unit 403 inquires of the sheet cassette control unit 404 about information pieces of the sheet size, the sheet type, and the sheet remaining amount of the stored sheets of all the sheet cassettes. In step S1305, the job control unit 403 conducts a search, based on the acquired information, as to whether there is a substitute sheet cassette storing sheets of which sheet size and sheet type conform to those of the sheets set in the sheet cassette of which sheet remaining amount is less than the threshold, in addition to the sheet cassette of which button 202 is pressed and of which sheet remaining amount is less than the threshold.

In step S1306, the job control unit 403 determines whether there is the substitute sheet cassette.

If the job control unit 403 determines there is no substitute sheet cassette (NO in step S1306), the job control unit 403 advances the processing to step S1310. In step S1310, the job control unit 403 instructs the sheet cassette control unit 404 to blink a lock lamp 203 of the sheet cassette of which sheet remaining amount is less than the threshold. Thus, the sheet cassette control unit 404 causes the lock lamp 203 of the relevant sheet cassette to blink. Then, the present processing is ended. Accordingly, a user can confirm that there is no substitute sheet cassette for the locked sheet cassette at the time.

On the other hand, in step S1306, if the job control unit 403 determines that there is the substitute sheet cassette (YES in step S1306), then in step S1307, the job control unit 403 inquires of the sheet cassette control unit 404 about a locked state of the substrate sheet cassette.

In step S1308, the job control unit 403 determines whether the substitute sheet cassette is locked. If the job control unit 403 determines that the substitute sheet cassette is locked (YES in step S1308), the job control unit 403 advances the processing to step S1310. In step S1310, the job control unit 403 instructs the sheet cassette control unit 404 to blink the lock lamp 203 of the sheet cassette of which button 202 is pressed. The sheet cassette control unit 404 causes the lock lamp 203 of the sheet cassette to blink. Then the present processing is ended. Accordingly, a user of the printing apparatus 101 can confirm that there is no substitute sheet cassette, which is not in use, for the locked sheet cassette.

On the other hand, in step S1308, if the job control unit 403 determines that the substitute sheet cassette is not locked (NO in step S1308), then in step S1309, the job control unit 403 instructs the sheet cassette control unit 404 to open the substitute sheet cassette. Then, the present processing is ended.

Accordingly, a user can supply sheets to the automatically opened sheet cassette as a substitute sheet cassette for the sheet cassette of which sheet remaining amount is less than the threshold. According to the present exemplary embodiment, the substitute sheet cassette is automatically opened based on the sheet remaining amount of the sheet cassette even without an explicit instruction from the user, thus the user can supply sheets thereto.

In the above-described eleventh exemplary embodiment, the control processing for opening the sheet cassette by automatically opening the substitute sheet cassette based on the remaining amount of the deck even without the explicit instruction from the user is described based on the first exemplary embodiment. In addition, as a twelfth exemplary embodiment, the eleventh exemplary embodiment can be applied to the second through the tenth exemplary embodiments.

In the above-described exemplary embodiments, an example in which a sheet cassette to be supplied with sheets is pushed out or an example in which a door of the sheet cassette to be supplied with sheets is opened are described. However, the present invention is not limited to the above examples and may be configured to perform control in which a sheet cassette which cannot be normally opened is placed into an openable state by a user instead of physically opening the sheet cassette.

Aspects of the present invention can also be realized by a computer of a system or apparatus (or devices such as a CPU or an MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-263387 filed Dec. 1, 2011, which is hereby incorporated by reference herein in its entirety.

What is claimed is:

1. A printing apparatus for feeding a sheet from any one of a plurality of sheet storage units to print an image on the fed sheet, the printing apparatus comprising:

a receiving unit configured to receive an instruction to open a sheet storage unit;

a specifying unit configured to specify, according to the instruction received by the receiving unit, based on an attribute set to the sheet storage unit to which the instruction is issued, another sheet storage unit to which an attribute same as the attribute is set; and a control unit configured to control the other sheet storage unit specified by the specifying unit to be opened.

2. The printing apparatus according to claim 1, further comprising:

a detecting unit configured to detect a paper-out state of the sheet storage unit; and a changing unit configured to change a sheet feeding source, based on the attribute, from the sheet storage unit of which paper-out state is detected by the detecting unit to another sheet storage unit to which an attribute same as that of the sheet storage unit is set.

3. The printing apparatus according to claim 1, further comprising:

a registering unit configured to register more than two sheet storage units among the plurality of sheet storage units as a group, wherein the specifying unit specifies, according to an instruction received by the receiving unit, the sheet storage unit from the sheet storage units belonging to the same group as the sheet storage unit to which the instruction is issued.

4. The printing apparatus according to claim 1, further comprising:

a sheet detecting unit configured to detect a sheet remaining amount of each sheet storage unit, wherein the specifying unit specifies, according to an instruction received by the receiving unit, a sheet storage unit storing less sheets remaining therein as the other sheet storage unit based on the attribute set to the sheet storage unit to which the instruction is issued and the detected sheet remaining amount.

5. The printing apparatus according to claim 1, further comprising:

a holding unit configured to store a history of sheet clogging (i.e., sheet jamming) of each sheet storage unit, wherein the specifying unit specifies, according to an instruction received by the receiving unit, a sheet storage unit having less frequency of sheet clogging as the other sheet storage unit based on the attribute set to the sheet storage unit to which the instruction is issued and information indicating sheet clogging frequency calculated from the history of the sheet clogging.

6. The printing apparatus according to claim 1, wherein the specifying unit removes a sheet storage unit in which a sheet clogging frequency is beyond a predetermined threshold from a selection candidate.

7. A method for controlling a printing apparatus for feeding a sheet from any one of a plurality of sheet storage units to print an image on the fed sheet, the method comprising:

receiving an instruction to open a sheet storage unit;

specifying, according to the received instruction, based on an attribute set to the sheet storage unit to which the instruction is issued, another sheet storage unit which has an attribute same as the attribute; and controlling the other specified sheet storage unit to be opened.

8. A non-transitory computer-readable storage medium storing a computer program for controlling a printing apparatus for feeding a sheet from any one of a plurality of sheet storage units to print an image on the fed sheet, the computer program comprising:

a code to receive an instruction to open a sheet storage unit;

a code to specify, according to the received instruction, based on an attribute set to the sheet storage unit to which the instruction is issued, another sheet storage unit which has an attribute same as the attribute; and a code to control the other specified sheet storage unit to be opened.

9. A printing apparatus for feeding a sheet from any one of a plurality of sheet storage units to print an image on the fed sheet, the printing apparatus comprising:

a receiving unit configured to receive an instruction to open a first sheet storage unit among the plurality of sheet storage units; and a control unit configured to receive the instruction according to the instruction received by the receiving unit and control a second sheet storage unit different from the first sheet storage unit to be opened if the first sheet storage unit is in use as a sheet feeding source for printing.

* * * * *